United States Patent [19]

Pencoske

[11] Patent Number: 4,911,085

[45] Date of Patent: Mar. 27, 1990

[54] COLLAPSIBLE TABLE

[76] Inventor: Edward L. Pencoske, 108B Colbaugh Rd., Trafford, Pa. 15085

[21] Appl. No.: 190,726

[22] Filed: May 5, 1988

[51] Int. Cl.[4] ..... A47B 3/00

[52] U.S. Cl. ..... 108/114; 108/115

[58] Field of Search ..... 108/114, 64, 89, 102, 108/134, 143, 152, 67, 113, 112, 115, 116, 117, 118, 119, 120

[56] References Cited

U.S. PATENT DOCUMENTS

| | | | |
|---|---|---|---|
| 429,458 | 6/1890 | Kraemer | 108/114 X |
| 493,441 | 3/1893 | Munz | 108/114 X |
| 1,639,367 | 8/1927 | Seward | 108/102 |
| 1,907,111 | 5/1933 | Holland et al. | 108/67 X |
| 2,619,394 | 11/1952 | Mahr | 108/64 |
| 2,872,259 | 2/1959 | Thorpe | 108/69 |
| 3,415,208 | 12/1968 | Thoresen et al. | 108/115 X |
| 3,656,439 | 4/1972 | Domin | 108/113 |
| 3,731,971 | 5/1973 | Sjogren | 108/113 X |
| 3,823,938 | 7/1974 | Unno | 108/112 X |
| 3,866,913 | 2/1975 | Zimmers et al. | 108/114 X |
| 4,005,898 | 2/1977 | Way | 108/117 X |
| 4,089,522 | 5/1978 | Rock | 108/112 X |
| 4,489,661 | 12/1984 | Fitzgerald | 108/115 X |
| 4,567,835 | 2/1986 | Reese et al. | 248/188.8 X |

FOREIGN PATENT DOCUMENTS

| | | | |
|---|---|---|---|
| 1542981 | 10/1968 | France | 108/114 |

*Primary Examiner*—Kenneth J. Dorner
*Assistant Examiner*—José V. Chen
*Attorney, Agent, or Firm*—Kirkpatrick & Lockhart

[57] ABSTRACT

A collapsible table is comprised of a first table top pivotally mounted on a first support and a second table top pivotally mounted on a second support. Structural members are provided for interconnecting the first and second supports. Those structural members are located to enable the first and second table tops to be pivoted from substantially horizontal to substantially vertical positions. A mechanism, carried by either the first and second supports or the interconnecting members, is provided for enabling the distance between the first and second table tops to be varied. In this manner, the table can be folded thereby greatly reducing the area required by the table while preserving the models secured to the top surface thereof.

13 Claims, 2 Drawing Sheets

COLLAPSIBLE TABLE

BACKGROUND OF THE INVENTION

1. Field of the Invention

The present invention is directed generally to tables and more particularly to tables of the type which can be collapsed or folded for storage.

2. Description of the Prior Art:

Tables which are capable of being collapsed or folded for storage are well known. See for example U.S. Pat. No. 1,223,782 issued Apr. 24, 1917 for a Folding and Extension Table. Although a wide variety of collapsible tables are available, none satisfies the needs of modelers who construct models of railroads, battlefields, or the like. None of the collapsible tables folds in a manner which preserves the modeler's work. Therefore, modelers typically construct their work on fixed tables or fixed work benches which require dedicated space. Accordingly, there is a need for a collapsible table which not only folds in a manner which does not destroy the modeler's work but is also capable of being stored in a position which protects the modeler's work.

SUMMARY OF THE INVENTION

The present invention is directed to a collapsible table having a first support pivotally carrying a first table top and a second support pivotally carrying a second table top. Members are provided for interconnecting the first and second supports. The interconnecting members are located to enable the first and second table tops to be pivoted from substantially horizontal to substantially vertical positions. A mechanism is provided for enabling the distance between the first and second table tops to be varied. That mechanism is carried by either the first and second supports or the members interconnecting the first and second supports.

According to one embodiment of the present invention, the members for interconnecting the first and second supports include a pair of telescoping members. According to this embodiment, the mechanism for enabling the distance between the first and second table tops to be varied includes compression fittings carried by the telescoping members. According to another embodiment of the present invention, the members for interconnecting the first and second supports include a pair of fixed members. According to this embodiment, the mechanism for enabling the distance between the first and second table tops to be varied includes two pair of roller members, with one pair of roller members being carried by each of the first and second support means. The roller members are pivotally connected to the first and second support means and rigidly connected to the first and second table tops, respectively.

The collapsible table of the present invention permits the modeler to practice his craft or hobby without having to provide dedicated space. The collapsible table of the present invention, when folded, requires only a fraction of the space required when the table is in its unfolded position. The collapsible table of the present invention may also be provided with casters thereby enabling the table to be moved in the collapsed position to a convenient storage area.

The collapsible table of the present invention folds in a manner such that the first and second table tops are in a facing relationship. Because of this, all of the modeler's work, e.g. scenery, buildings, etc. are protected by the table while the table is in its folded position. Additionally, in such a position, the underside of the table is completely exposed thereby facilitating wiring or other types of work normally performed on the underside of the table.

The modeling table is additionally constructed such that the first and second table tops are pivotally mounted substantially about their center of gravity. Thus, no heavy lifting is involved in folding or unfolding the table. This enables the table to be folded or unfolded in a short period of time by only one person.

Because the collapsible table of the present invention can be mounted on casters, and it protects the modeler's work when it is in the collapsed position, transporting the modeler's work to competitions, shows, exhibits or the like is greatly facilitated. Additionally, the structure of the present invention enables several tables to be connected together to make an even larger display. This feature is of value to modeling clubs and the like. These and other advantages and benefits of the present invention will become apparent from a description of the preferred embodiment hereinbelow.

BRIEF DESCRIPTION OF THE DRAWINGS

In order that the present invention may be clearly understood and readily practiced, preferred embodiments of the present invention will be described in conjunction with the figures wherein.

DETAILED DESCRIPTION OF THE PREFERRED EMBODIMENT

Figure 1:
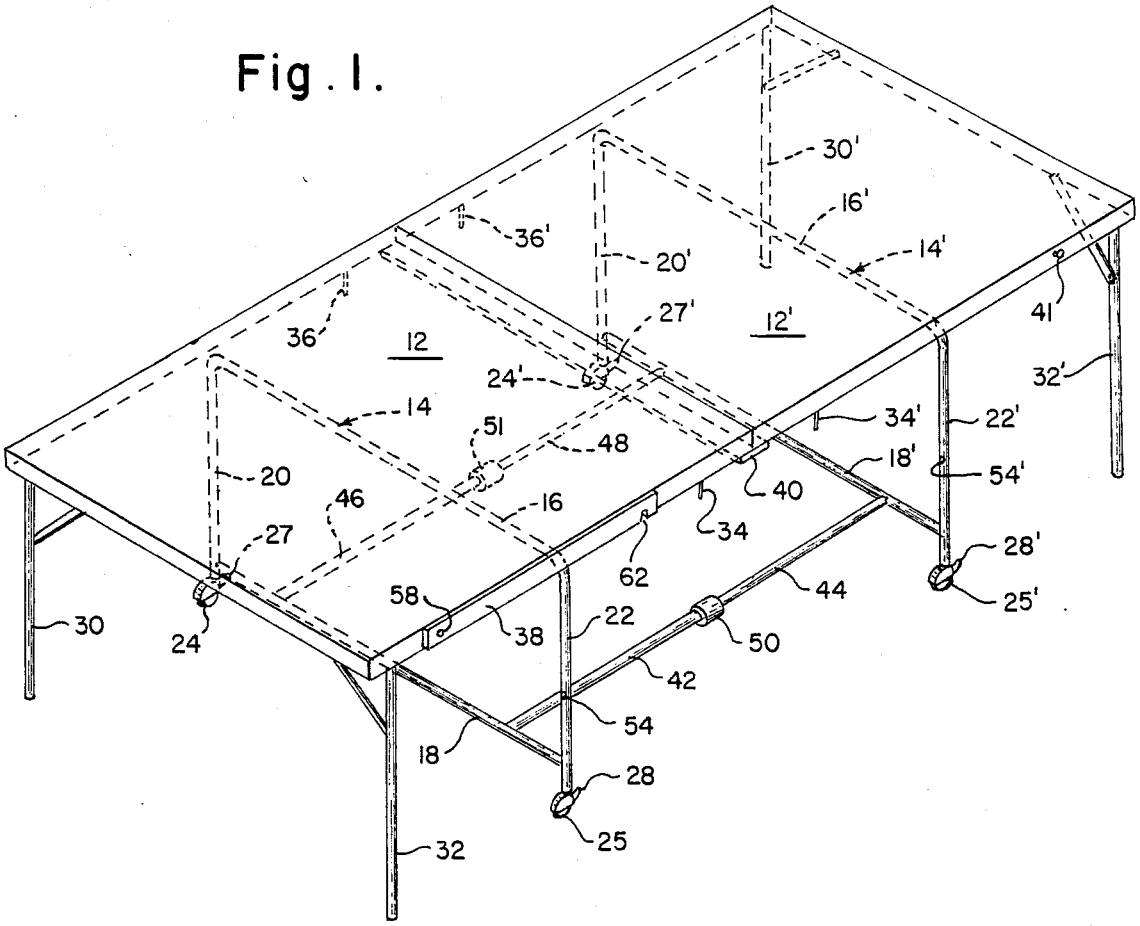
FIG. 1 is a perspective view of the collapsible table of the present invention in an unfolded state.
Figure 2:
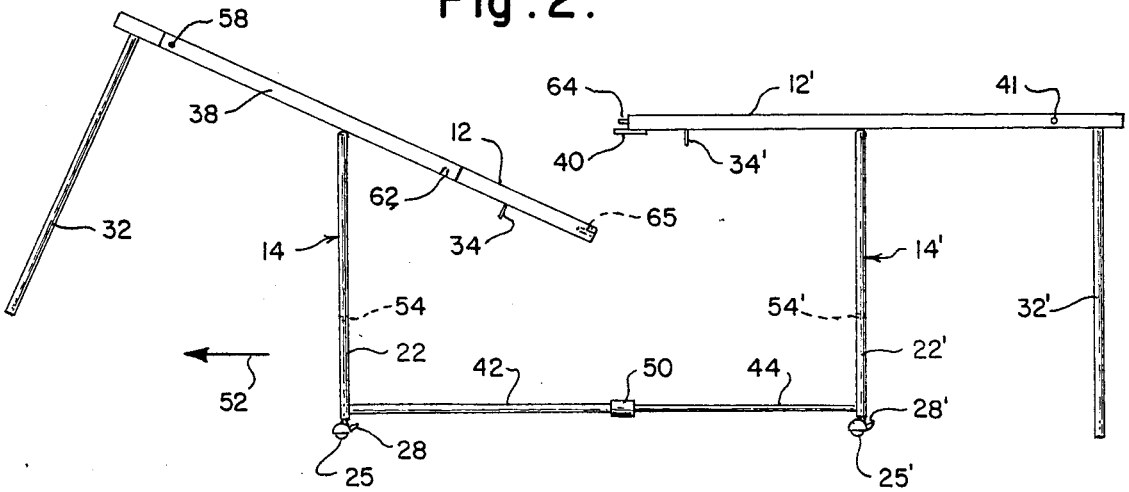
FIG. 2 is a side view of the present invention during transition from an unfolded to a folded state.
Figure 3:
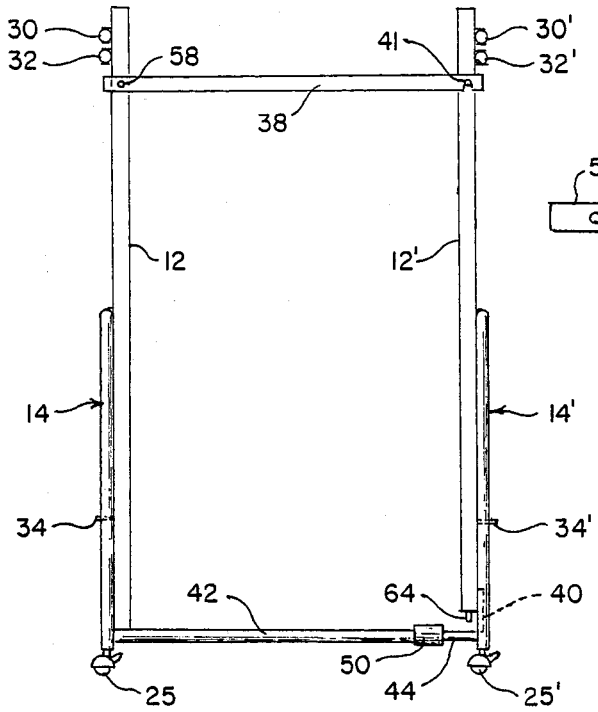
FIG. 3 is a side view of the present invention in a folded state.

A collapsible table 10 constructed according to the teachings of the present invention is illustrated in FIGS. 1, 2, and 3 in an unfolded state, during transition from an unfolded to a folded state, and in a folded state, respectively. The collapsible table 10 is comprised of a first table top 12 carried by a first support means 14. The first support means 14 is a generally rectangular-shaped support having a top member 16, a bottom member 18, and two side members 20 and 22. The first table top 12 may be pivotally mounted to the top member 16 by means of a U-bolt (not shown) in event that the top member 16 is tubular, by a piano hinge (not shown) in the event that the top member 16 has a flat top surface, or any other suitable means for mounting consistent with the configuration of the top member 16. Each of the side members 20 and 22 carries at its lower extremity a caster or roller 24 and 25, respectively. The casters 24 and 25 are known commercially available casters of the type which can be locked in position by operation of locking levers 27 and 28, respectively, to prevent movement.

Figure 4:
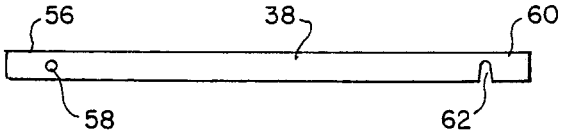
FIG. 4 illustrates a storage bar.

The first table top 12 also carries a pair of conventional folding table legs 30 and 32 similar to those found on card tables or the like. The first table top 12 additionally carries a pair of locking pins, 34 and 36, which are used during storage and which will be described in greater detail in conjunction with FIG. 3 hereinbelow. Finally, the first table top 12 carries a pair of storage bars, only one of which 38 is seen in FIG. 1. The storage bar 38 is shown in detail in FIG. 4. The storage bar 38 is used when the table is in its folded state. The function of the storage bar 38 will be described in greater detail hereinbelow in conjunction with FIG. 3.

The collapsible table 10 also includes a second table top 12' carried by a second support means 14'. The second table top 12', second support means 14', and the various members carried by the second table top 12', are substantially identical in construction and operation to those previously described hereinabove in conjunction with the first table top 12. For that reason, the construction of the second table top 12', the second support means 14', and the members carried by the second table top 12' will not be repeated. However, for the convenience of the reader, components performing the same function have been given the same reference number together with the prime designation to indicate that that member or component is associated with the second table top 12'.

The second table top 12' carries an additional member 40 for which the first table top 12 has no corresponding member. The member 40 is mounted along the edge of the second table top 12' which forms the joint between the first table top 12 and second table top 12' as seen most clearly in FIG. 2. The joint member 40 is mounted in such a manner that it extends beyond the edge of the second table top 12'. The purpose of the member 40 is to provide support for the joint between the first table top 12 and second table top 12'. For this reason, the member 40 should be constructed of a sufficiently rigid material so as to prevent the joint between the two table tops from sagging.

The first support means 14 and the second support means 14' are interconnected by a first pair of telescoping members 42 and 44 and a second pair of telescoping members 46 and 48. The first and second pairs of telescoping members are identical in construction and operation such that only one pair of the telescoping members will be described in detail.

The members 42 and 44 are sized such that the inside diameter of the member 42 is greater than the outside diameter of the member 44 such that the member 44 may slide into and be retained by the member 42. The members 42 and 44 carry a conventional compression fitting 50. The compression fitting 50 is of the type which has internal threads (not shown) which mate with external threads carried by the member 42. The compression fitting 50 has a tapered inside diameter as is well known in the art such that upon screwing the compression fitting onto the threads of the member 42, a collapsible washer or the like (not shown) rigidly engages the member 44 thereby preventing motion of the member 44 relative to the member 42. Upon unscrewing the compression fitting 50, the collapsible washer ceases engagement of the member 44 thereby permitting movement of the member 44 relative to the member 42. Compression fittings are well known in the art such that a further description of such fittings is not required.

When the collapsible table is in an unfolded state as is shown in FIG. 1, the first table top 12 defines a work surface which is the upper surface of the table top. In a similar manner, the second table top 12' defines a second work surface which is the upper surface of the table top. When the collapsible table 10 is in a folded state as shown in FIG. 3, the first and second work surfaces are in a facing relationship. The sequence of steps needed to place the collapsible table in a folded state are described in conjunction with FIG. 2.

In FIG. 2, a side view of the collapsible table is shown during transition from an unfolded to a folded state. In order to fold the collapsible table, the casters 24 and 25 are unlocked. Thereafter, the compression fittings 50 and 51 are loosened to enable motion of the members 44 and 48 relative to the members 42 and 46. The first table top 12 and first support means 14 are pulled in the direction of the arrow 52 to increase the distance between the first table top 12 and the second table top 12'. This increase in distance allows the end of the table top 12 which forms the joint with the second table top 12' to be pulled free of the joint member 40. This increase in distance also provides some clearance for pivoting of the first table top 12 in the event there are buildings or other tall structures located close to the joint between the first and second table tops. After sufficient clearance has been obtained, the first table top 12 is pivoted about the first support means 14 until it is in a substantially vertical position as shown in FIG. 3. When in the vertical position, the pin 34 carried by the first table top 12 extends through an opening 54 in the member 22. The pin 34 has an opening (not shown) in its distal end for receiving a cotter pin or the like so that the first table top 12 may be locked in the substantially vertical position. Thereafter, the legs 30 and 32 are folded in a conventional manner. After the first table top 12 has been secured in the substantially vertical position, the second table top 12' may be similarly pivoted about the second support means 14' into a substantially vertical position as shown in FIG. 3. The locking pin 34' extends through the opening 54' in the member 22' to enable the second table top 12' to be locked in the substantially vertical position.

After the first and second table tops have been locked in the substantially vertical position, the first and second support means can be brought closer together. This can be accomplished because the casters 24 and 25 are in an unlocked condition, the casters 24' and 25' are in a locked condition, and the compression fittings 50 and 51 are in a loosened condition. Pushing on the first support means 14 in a direction opposite to that of arrow 52 causes the members 44 and 48 to telescope within the members 42 and 46, respectively, thereby bringing the first support means 14 closer to the second support means 14'. The varying of the distance between the first and second support means may be limited by the height of the structures on the work surfaces. However, it is anticipated that the length of the member 42 will be substantially long enough, for example three feet, such that the entirety of the members 44 and 48 may be telescoped within the members 42 and 46 as shown in FIG. 3.

When the first and second support means have been brought as close together as possible, the compression fittings 50 and 51 are tightened and casters 24 and 25 are locked. In the event that the first and second support means have been brought together as closely as possible, the storage bars 38 may be used. The storage bar 38, shown in detail in FIG. 4, has a first end 56 having an aperture 58 for pivotally connecting the storage bar to the first table top 12. The storage bar 38 has a second end 60 having a notch 62 which mates with the shaft portion of a protruding bolt member 41. When the storage bars 38 are in such a position, they add substantial rigidity to the collapsible table 10 and ensure that the table 10 will remain in the folded state.

In order to unfold the table, the series of steps for folding the table are reversed. That is, in FIG. 3, the storage bars 38 are disconnected from the protruding bolt members 41. Thereafter, compression fittings 50 and 51 are loosened and the casters 24 and 25 unlocked. The first support means 14 is then pulled in a direction indicated by arrow 52 in FIG. 2. After sufficient clearance between the first support means 14 and the second support means 14' has been achieved, the legs 30 and 32 are unfolded, the cotter pins extending through locking pins 34 and 36 are removed, and the first table top 12 is pivoted from a substantially vertical to a substantially horizontal position.

Legs 30' and 32' of the second table top 12' are unfolded and the cotter pins extending through locking pins 34' and 36' are removed. The second table top 12' is then pivoted from a substantially vertical to a substantially horizontal position.

With both table tops in a substantially horizontal position, the first support means 14 is moved in a direction opposite that of the arrow 52 to bring the first table top 12 into alignment with the second table top 12'. A number of guiding dowel pins 64, shown in FIG. 2, may be carried by one of the table tops for mating with corresponding holes 65 in the other table top to ensure consistent alignment of the two table tops. After the two table tops have been properly aligned and joined together, the compression fittings 50 and 51 may be tightened and the casters 24 and 25 locked.

The present invention offers numerous advantages not found in prior art tables. For example, a table ten feet long and six feet wide provides sixty square feet of modeling space when the table is in the unfolded state. For such a table, it is anticipated that the members 42, 44, 46, and 48 may each be approximately three feet long. With the collapsible table 10 in a completely folded condition as shown in FIG. 3, the table has a length of only three feet. Thus, the table only requires eighteen square feet of storage space. For a table which is ten feet long, it is anticipated that each of the table tops 12 and 12' would be centered about its support means. Because of that, there is no heavy lifting required to pivot the table tops from a substantially horizontal to a substantially vertical position. For that reason, only one person is needed to fold or unfold the table. The simplicity of operation of the table enables the table to be folded or unfolded in a matter of minutes.

When the table is in the folded position as shown in FIG. 3, the models and scenery carried by the work surfaces of the table are in a facing relationship and therefore protected by the modeling table itself. Also, in this condition, the underside of both work surfaces is exposed thereby facilitating wiring or other work which must be done on the underside of the table. When in the folded position, the edge of the first table top 12 rests on the members 42 and 46 such that the weight of the table top is not carried by the member pivotally connecting the table top to the first support means 14. Similarly, the weight of the second table top 12' is born by the members 44 and 48 contacting joint member 40. When the table is in the folded state, a blanket or cover may be placed over the table thereby keeping the model clean of dust and dirt.

In addition to the foregoing advantages, the table of the present invention will be useful for modeling clubs which may wish to connect several tables together. Additionally, because of the casters and the fact that when the table is folded the model is completely protected, transportation of the table to competitions or exhibitions is greatly facilitated. Finally, and perhaps one of the most important features of the present invention is that it enables the modeler to practice his craft or hobby without having to provide dedicated space in his or her house.

It is anticipated that numerous variations and alternative embodiments of the present invention will be conceived by those of ordinary skill in the art. For example, it is anticipated that the compression fittings 50 and 51 may be replaced by a collar carrying a set screw. It is additionally anticipated that the telescoping members 42, 44, 46, and 48 and compression fittings 50 and 51 may be replaced by a screw thread and ball socket or a plurality of x-shaped members pivotally connected together so that they can collapse in an accordian-like fashion. It is anticipated that numerous mechanical equivalents of the telescoping members ay be provided for interconnecting the first and second support means and for enabling the distance between the first and second table tops to be varied.

Figure 5:
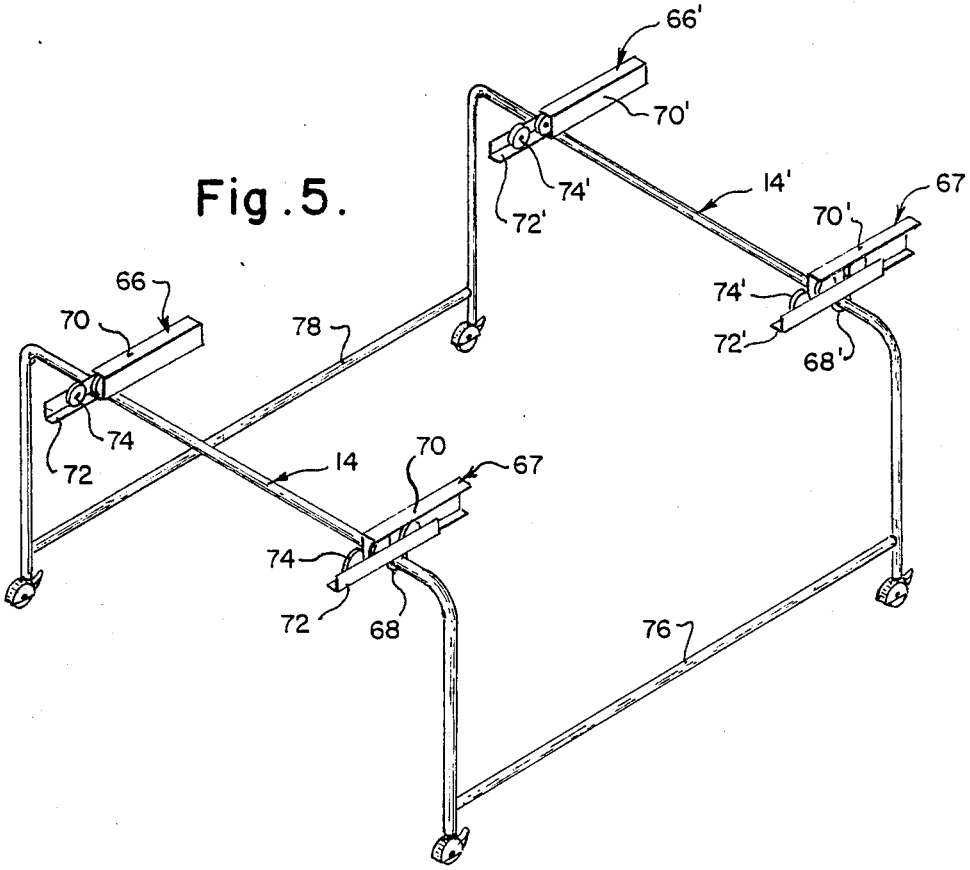
FIG. 5 illustrates the frame of another embodiment of the present invention.

According to another embodiment of the present invention, the mechanism for enabling the distance between the first and second table tops to be varied is carried by the first and second support means 14 and 14' as shown in FIG. 5. In FIG. 5, roller assemblies 66 and 67 are carried by the first support means 14 while roller assemblies 66' and 67' are carried by the second support means 14'. Each of the roller assemblies may be pivotally connected to its support means through the use of a U-bolt 68 in the event that the support means is tubular in construction. Each of the roller assemblies is a known, commercially available unit wherein a top portion 70 moves relative to a bottom portion 72 by virtue of a plurality of rollers 74. With the top portion 70 of each roller assembly rigidly connected to a table top, and the bottom portion 72 pivotally connected to a support means, the roller assemblies 66, 67, 66' and 67' facilitate varying the distance between the first and second table tops as well as enabling pivoting of each of the table tops from a substantially horizontal to substantially vertical position. Because all relative movement of the table tops is provided by the roller assemblies, fixed members 76 and 78 may be provided for interconnecting the first support means 14 and the second support means 14'.

While the present invention has been described in conjunction with preferred embodiments thereof, it is anticipated that various modifications and variations will be apparent to those of ordinary skill in the art. This disclosure and the following claims are intended to cover all such modifications and variations.

What is claimed is:

1. A collapsible table, comprising:

first support means;

first table top means pivotally mounted on said first support means;

second support means;

second table top means pivotally mounted on said second support means;

interconnecting means connecting said first support means to said second support means, said interconnecting means being located a sufficient distance from the pivot point between said first and second table top means and their respective support means so as not to interfere with the pivoting of said first and second table top means from substantially horizontal to substantially vertical positions, when in a horizontal abutting position said first and second table top means define a substantially continuous joint running the width of said first and second table top means; and means for enabling the distance between said first and second table top means to be varied, said means being carried by one of (i) interconnecting means and (ii) said first and second support means.

2. The table of claim 1 wherein said first and second table top means each define a work surface, and wherein said work surfaces are in a facing relationship when said first and second top means are pivoted to said substantially vertical positions.

3. The table of claim 2 additionally comprising a joint member carried by said second table top means.

4. The table of claim 3 wherein said interconnecting means is located so that an edge of said first table top means and an edge of said joint member carried by said second table top means rest upon said interconnecting means when said table top means are in said substantially vertical position.

5. The table of claim 1 wherein said interconnecting means includes a pair of telescoping members connecting said first support means to said second support means, and wherein said means for enabling includes compression fitting means carried by said telescoping members for controlling the degree of telescoping.

6. The table of claim 1 wherein said interconnecting means includes a pair of fixed members, and wherein said means for enabling includes a first plurality of roller members pivotally mounted between said first table top means and said first support means and a second plurality of roller members pivotally mounted between said second table top means and said second support means.

7. The table of claim 1 additionally comprising a plurality of casters carried by said first and second support means.

8. The table of claim 7 additionally comprising a first plurality of folding legs carried by said first table top means and a second plurality of folding legs carried by said second table top means.

9. The table of claim 1 additionally comprising a plurality of pins carried by said second table top means along an edge that abuts said first table top means, and additionally comprising a plurality of apertures formed in said first table top means along an edge that abuts said second table top means, said pins and apertures being aligned to facilitate insertion of said pins into said apertures when the table is in an unfolded state.

10. The table of claim 1 additionally comprising a locking pin carried on the underside of said first table top means and additionally comprising an aperture formed in said first support means for receiving said locking pin when the table is in a folded state.

11. The table of claim 1 additionally comprising a storage bar carried by said first table top means, said storage bar being of sufficient length so as to interconnect said first and second table top means when the table is in a folded state.

12. A table capable of assuming a folded and unfolded state comprising:

first support means;

first table top means pivotally mounted on said first support means;

second support means;

second table top means pivotally mounted on said second support means;

interconnecting means connecting said first support means to said second support means, said interconnecting means being located a sufficient distance from the pivot point between said first and second table top means and their respective support means so as not to interfere with the pivoting of said first and second table top means from substantially horizontal to substantially vertical positions, when in a horizontal abutting position said first and second table top means define a substantially continuous joint running the width of said first and second table top means, said interconnecting means being constructed such that the distance between said first and second table top means can be varied.

13. The table of claim 12 additionally comprising a first plurality of locking casters carried by said first support means and a second plurality of locking casters carried by said second support means.

* * * * *